US005314252A

United States Patent [19]

Happ

[11] Patent Number: 5,314,252

[45] Date of Patent: May 24, 1994

[54] SEALABLE SQUARE BOTTOM CONTAINER APPARATUS

[75] Inventor: Thomas W. Happ, Boswell, Ind.

[73] Assignee: AB Specialty Packaging, Inc., Hialeah, Fla.

[21] Appl. No.: 959,290

[22] Filed: Oct. 9, 1992

[51] Int. Cl.[5] ..... B65D 30/18

[52] U.S. Cl. ..... 383/126; 383/120; 426/107

[58] Field of Search ..... 383/104, 120, 121, 125, 383/126; 426/107; 493/218

[56] References Cited

U.S. PATENT DOCUMENTS

| | | | |
|---|---|---|---|
| 2,353,311 | 7/1944 | Karlson | 383/126 X |
| 2,353,605 | 7/1944 | Waters | 383/126 |
| 3,734,395 | 5/1973 | Erk et al. | 383/126 X |
| 4,943,456 | 7/1990 | Pollart et al. | 426/107 X |
| 4,972,058 | 11/1990 | Benson et al. | 426/107 X |
| 4,976,674 | 12/1990 | Yanuzzi, Jr. et al. . | |
| 5,011,299 | 4/1991 | Black, Jr. et al. . | |

FOREIGN PATENT DOCUMENTS

| | | | |
|---|---|---|---|
| 0880250 | 10/1961 | United Kingdom | 383/125 |

*Primary Examiner*—Allan N. Shoap
*Assistant Examiner*—Jes F. Pascua
*Attorney, Agent, or Firm*—Dick and Harris

[57] ABSTRACT

A sealable square bottom container apparatus comprising one or more plies of sheet material. The square bottom of the container apparatus includes a continuous ring of sealable adhesive to form a substantially sift-proof bottom panel after articulation and sealing of the bottom of the container apparatus. Such a continuous ring forms a positive seal towards preventing the inadvertent migration or seepage of articles from within said container apparatus, particularly articles such as oils, steam, fluids and fine powder materials—without the need for an additional patch, sealing pastes or preliminary welds applied to the bottom of the container apparatus. Alternative adhesives such as heat sealable adhesives, cohesives and other suitable adhesives may be positioned in a pattern along the interior and exterior of the container bag to create either an adhesive to adhesive bond or an adhesive to bag material bond; to effectuate such a continuously sealed periphery without such additional bottom panel sealing pastes, patches or preliminary welds.

23 Claims, 3 Drawing Sheets

SEALABLE SQUARE BOTTOM CONTAINER APPARATUS

BACKGROUND OF THE INVENTION

The present invention relates in general to a container apparatus and in particular to a sealable square bottom container bag for enclosing articles therewithin.

While many different containers have been used to enclose and carry items of various sizes, there have been difficulties in developing appropriate containers to carry various articles that are particularly small or liquid, such as oils, steam, or fine powdered materials. The concern with containing such articles has also become relevant in the food industry, with greater use of microwave ovens.

A common type of container used in a microwave oven is a bag. In order for a bag to be able to contain certain items for cooking in a microwave oven as well as for other non-microwave applications, items such as oils, fluids and fine powders, the bag must by "sift-proof", in other words there must exist a positively sealed secure periphery at all corners and edges of the bag bottom.

A common prior art bag, known in the industry as a full diamond fold bag does not meet the requirements of being sift-proof. There exists an area of space in the bottom panel of the bag which could lead to inadvertent seepage or spillage of the contents of the bag to the outside environment. In order to completely seal the bottom panel of a full diamond fold bag, a separate patch must often be adhered to the bottom of the bag to ensure that all folds and edges along the bottom of the bag are sift-proof. While providing an effective place to position advertisements or other information, this patch requires not only extra material to make, but extra adhesive to attach the patch to the bottom of the bag, as well as an extra printing operation.

It is possible to create a sift-proof bag as known in the prior art, however, in order to do this, the bag must often be constructed of multiple plies or layers of material. Essentially, what occurs with such a multi-ply bag is that the plies are staggered and overlap each other at potential sift areas. Adhesion through staggering or overlapping creates the sift-proof effect. While this method does have the advantage of allowing a bag to be formed from more than one material, for instance, the inner ply can be made from a grease-proof or wax-like material and the outer ply be made of a paper material; the extra ply, material and costs required to form such a bag may not always be desired. Furthermore, these bags often use pastes instead of printed, pre-cured, sealable adhesives to secure the various panels. This may lead to sloppy application and "squeeze out" of excess uncured adhesive from beneath the various panels and edges as well as lead to manufacturing speed and spill problems with the bag forming equipment. Prior art bags have additionally used more costly preliminary linear welds along the entire bag bottom, to ensure a sift-proof construction, prior to the further steps of folding, articulation and additional sealing of the flaps created by the preliminary welds.

It is therefore an object of the present invention to provide a container apparatus which may be formed from a single or multiple plies of bag material, which requires neither an additional patch to be placed on the bottom of the container, nor a preliminary horizontal or vertical bag weld along the bottom, in order to provide a sift-proof container.

It is further an object of the present invention to minimize the amount of resources, namely adhesives and container material, required to form and articulate the container apparatus; and to eliminate adhesive spillage during "squeeze out" of such adhesive.

An additional object of this invention is to provide an S.O.S. (self-opening sack) product that is not only sift-proof but is capable of being formed economically and at a high rate of speed from a single ply of bag material—through formation and sealing on conventional bag-bottomer equipment in a substantially flat, high speed configuration; without such preliminary welding, in a third dimension, along the bottom edges of the bag. It is accordingly an objective of the invention to provide a container apparatus which requires minimal machine time, effort and materials to form such an apparatus, through application of an adhesive pattern that positively seals the bottom in a flat configuration, without inadvertently adhering a portion of the bottom to the interior of a front, back or side panel.

These and other objects of the invention will become apparent in light of the present specification and drawings.

SUMMARY OF THE INVENTION

The present invention comprises a sealable square bottom container apparatus for storing, shipping and using various size articles within the apparatus. The square bottom of the container apparatus is completely sealed and therefore "sift-proof", to prevent the inadvertent migration of smaller sized articles and other difficult-to-contain articles such as fine powdered materials and oils from within the apparatus to the outside environment.

The apparatus comprises one or more layers of bag forming material which includes a front panel, a back panel, a bottom panel and side panels. The front, back and side panels are operably arranged so as to be easily articulated and deployed into a contiguous tube configuration, where the front panel and back panel are opposite to each other, with the respective side panels being interposed therebetween. Additionally, the bottom panel comprises a front panel closure flap, a back panel closure flap, and side panel closure flaps, each of which hingedly emanates from respective front, back and side panels at respective front, back and side flap folds.

In the preferred embodiment, the interior and exterior surfaces of one or more of the front, back and side panel closure flaps are laminated with sealable adhesive. Upon articulation of the front, back and side panel closure flaps into the bottom panel, a substantially closed, positively locked, continuous ring of sealable adhesive is formed around the entirety of the bottom panel periphery. This positively locked ring of sealable adhesive operably prevents inadvertent migration or seepage of articles, such as oils, steam, fluids and fine powdered particulates from within the interior of the container apparatus. This seal is accomplished without the application of an additional non-integrated patch to the bottom panel of the container apparatus as required in some prior art, as well as without supplemental adhesives or preliminary bottom panel linear welds.

In one preferred embodiment, the sealable adhesive material comprises a heat sealable adhesive material, preferably a polyvinyl acetate heat sealable adhesive.

In another preferred embodiment of the invention, the sealable adhesive material positioned on two or more of the front, back and side panel closure flap means, creates the positively locked continuous periphery of sealed attachment upon articulation and juxtapositioning of that adhesive layer with another aligned layer of sealable adhesive material positioned among the two or more front, back and side panel closure flap means. Upon the sealable alignment and affixation of the one layer of sealable adhesive material on the front, back and side panel closure means with the other aligned layer of sealable adhesive material on the front, back and side panel closure means, an improved adhesive to adhesive bond is created to further effectuate the positively locked seal periphery. In one such embodiment the sealable adhesive material is likewise a heat sealable adhesive material preferably comprising a polyvinyl acetate heat sealable adhesive.

In yet another preferred embodiment of the invention, the sealable adhesive material comprises a cohesive adhesive material; one which is incapable of bonding directly to paper when cured, but rather fixedly sealable to a corresponding aligned and juxtaposed layer of like cohesive adhesive material. In this preferred embodiment the cohesive adhesive material comprises a cohesive having an applied thickness in the range of 0.5 to 1.5 mils with a solid content ranging from 50 to 60 percent.

The respective side panels of the preferred embodiment may be gusseted so that, prior to articulation and filling of the apparatus, the side panels are folded about the gusset folds which are positioned towards each other and the interior region of the container apparatus. The side panels also include gusseted collapse folds which permit the side panels to obtain a minimized profile prior to deployment and articulation of the container apparatus. Assisting in the potential minimization of the container apparatus profile, and sealed formation, are bag collapse folds which are operably positioned in one or more of the respective front and back panels. The bag collapse folds traverse the entirety of at least one of the respective front and back panels, and are positioned between the respective front and back panels so as to cooperate with the gusset collapse folds positioned in the respective side panels.

The sealable adhesive material is positioned on at least a portion of both the exterior and interior surfaces of the front and back closure flaps. In this preferred embodiment, the adhesive material is located solely on the exterior surface of the respective side panel closure flaps. The back panel closure flap further includes two vertical slits extending from the bottom end of the tube member formed by the bag material, towards the back flap fold in the back panel of the container apparatus. These cuts permit the formation of an integrated closure patch which is further utilized to enhance the seal effectiveness of the sealable adhesive positioned on the front, back and side panel closure flaps—when articulated into the bottom panel of the container apparatus.

In the preferred embodiment also, the integrated closure patch is devoid of any sealable adhesive material on its exterior surface. Conversely, the interior surface of the integrated closure patch is covered with sealable adhesive, except for a region which is adjacent to the back flap fold, which region extends downwardly towards the bottom end of the back panel closure flap. This non-adhesive region comes in contact with the back panel upon articulation of the front, back and side panel closure flaps into the bottom panel, thereby permitting the formation of the sealed periphery without the adherence of the back panel closure flap to the back panel upon sealing of the entirety of the bottom panel. Also facilitating the formation of the positively sealed periphery are two columns of sealable adhesive positioned on the interior surface of the front panel closure flap proximate to the respective side edges of the front panel closure flap, between the lower edge of the front panel closure flap and the front flap fold.

The preferred embodiment of the container apparatus includes a top seal member for completely enclosing articles within its interior, located proximate to the top edges of the front, back and side panels. This top seal member preferably comprises a contiguous ring of equivalent sealable adhesive which forms another seal around the top edges of the front, back and side panels respectively.

The bag material of the container apparatus of the preferred embodiment is comprised of one or more plies of bag material. Where the container apparatus is comprised of solely one ply of bag material, this material may be formed out of paper. Similarly, where the container apparatus is formed from two plies of bag material, both plies may be comprised of paper or in the alternative, the inner ply may be comprised from a grease-proof or wax-like material (which may also comprise various forms of paper) while the outer ply is formed from a paper material. Additionally, the container apparatus may include a heat enhancing element or susceptor, sandwiched between the inner-most ply and the outer ply of bag material. This heat enhancing element may be located in any panel, however, it is preferred that it be located in the back panel.

An appropriate heat sealable adhesive adequate to maintain a sift-proof bond may be utilized. One such effective heat sealable adhesive is a polyvinyl acetate adhesive such as that supplied by AJAX Adhesives Co. under its number 453-1D or National Adhesive's product number 32-1283. Likewise, the seam formed when the bag sheet material is articulated into the contiguous tube, with a side panel overlapping the front panel, is preferably secured by a water-based adhesive such as National Adhesive's product number 723873.

In the preferred embodiment utilizing heat sealable adhesive for the bottom panel sealing means, as shown in FIG. 13, the position of back panel flap 69 may be preliminarily secured by a spot of adhesive, if necessary, prior to introducing the container into a heat applying "bottomer" machine; to preserve the position of flap 69 prior to fully secured adhesion. Where the heat application equipment is integrated with the tube formation equipment, to receive the container directly without changes in processing direction, no such preliminary glue spot is required.

In alternative embodiments, suitable non-heat-sealing adhesives may be utilized, such as a cohesive adhesive, which is encapable of bonding directly to paper, but rather seals upon alignment and contact with another layer of like cohesive adhesive. Such cohesive materials are preferably applied in a thickness ranging from 0.5 to 1.5 mil, with a solid content ranging from 50 to 60 percent; available from companies such as Port City Adhesives of Wilmington, N.C.

DETAILED DESCRIPTION OF THE DRAWINGS

Figure 1:
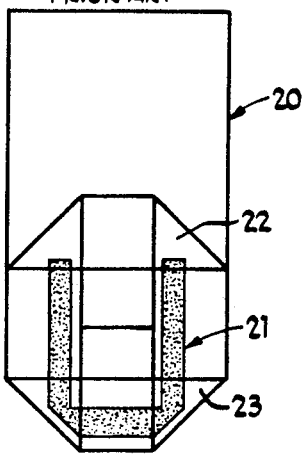
Fig 1 PRIOR ART
FIG. 1 of the drawings is an elevated front view of a prior art container apparatus having a bottom fold configuration typically referred to as a full diamond fold configuration.

While this invention is susceptible of embodiment in many different forms, there is shown in the drawings and will herein be described in detailed, several specific embodiments with the understanding that the present disclosure is to be considered as an exemplification of the principles of the invention and is not intended to limit the invention to the embodiments illustrated.

Figure 2A:
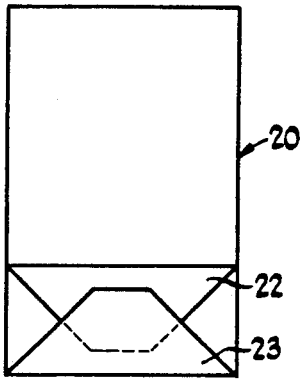
Fig 2A PRIOR ART
FIG. 2A of the drawings is an elevated front view of the prior art container apparatus of FIG. 1, with its bottom panel means fully deployed, articulated and sealed.
Figure 2B:
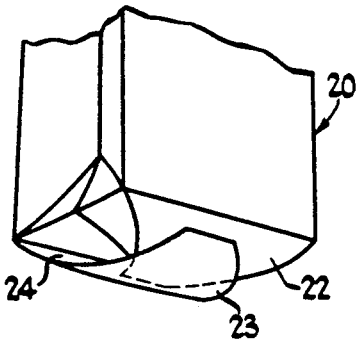
Fig 2B PRIOR ART
FIG. 2B of the drawings is a side, bottom perspective view of a prior art container apparatus bottom in its partially articulated and sealed position, in which a gap can exist between the portion of the bottom panel means formed by the front panel and back panel closure flap means, and the portion of the bottom panel means formed by the respective side panel closure flap means.
Figure 3:
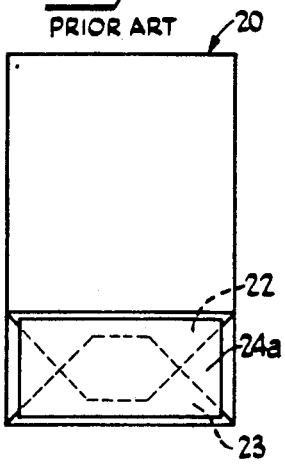
Fig 3 PRIOR ART
FIG. 3 of the drawings is an elevated front view of the prior art container apparatus of FIGS. 1 through 2B, wherein the bottom panel closure means further includes an adhesively applied non-integrated patch.

Prior art container apparatus 20, as shown in FIGS. 1-3, is in the full diamond fold configuration. The bottom panel means of prior art container apparatus 20 comprises top section 22 and bottom section 23 each of which includes a region of heat sealable adhesive material 21 on their exterior surfaces. Upon their articulation and formation into the bottom panel, bottom section 23 overlies at least a portion top section 22 so that heat sealable adhesive material 21 is engaged and retains top section 22 and bottom section 23 to each other and in their respective positions as shown in FIG. 2A. However, as shown in FIG. 2B, the configuration of prior art container apparatus 20 does not always create a complete seal along the periphery of the bottom panel means. While bottom section 23 overlaps top section 22, there may exist a void region 24 between top section 22 and the remainder of container apparatus 20, thereby allowing for possible inadvertent migration of articles from within container apparatus 20. In order to provide a sift-proof container apparatus, container apparatus 20, in the full diamond fold configuration should include a non-integrated patch 24*a* which adhesively overlays portions of top section 22 and bottom section 23. Non-integrated patch 24*a* is adhesively attached to bottom panel means of container apparatus 20 to, in turn, completely seal any possible void region 24 existing between top section 22, bottom section 23 and the remainder of prior art container apparatus 20.

Figure 4:
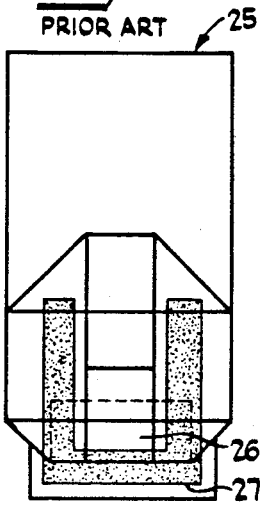
Fig 4 PRIOR ART
FIG. 4 of the drawings is an elevated front view of a prior art container apparatus consisting of multiple plies of bag material wherein the inner ply of the material is characterized by a reverse fold in the bottom panel of the container apparatus.

As shown in FIG. 4, prior art container apparatus 25 comprises two or more plies of bag means. An inner ply of material may be formed from a film or coated paper while the outer ply is a substantially paper material. The inner ply of FIG. 4 is cut in a reverse-fold configuration to form a paper area 26 so that the adhesive on the integrated patch 27 of prior art container apparatus 25 is able to bond to paper area 26 thereby forming a paper-to-paper bond.

Figure 5:
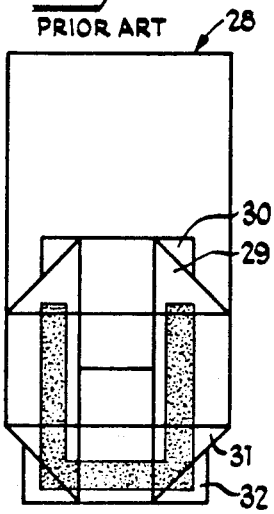
Fig 5 PRIOR ART
FIG. 5 of the drawings is an elevated front view of a prior art container apparatus constructed of multiple plies of bag material and configured so the inner plies are in a diamond fold configuration on the bottom panel means.
Figure 6:
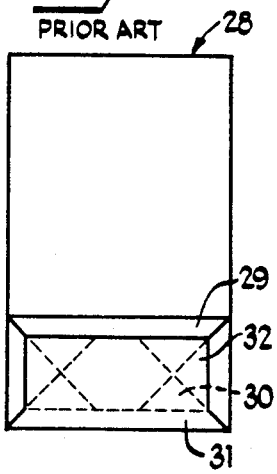
Fig 6 PRIOR ART
FIG. 6 of the drawings is an elevated front view of the prior art container apparatus of FIG. 5, wherein said bottom panel means has been fully deployed, articulated and sealed into a sift-proof closure configuration.

Prior art container apparatus 28 is a modified sift-proof slit configuration as shown in FIGS. 5 and 6, and requires multiple plies of bag means in order to form a sift-proof seal. Both top section 29 and bottom section 31 of the bottom panel means of prior art container apparatus 28 contain integrated patch regions 30 and 32 respectively. Upon complete articulation, as shown in FIG. 6, integrated patch region 32 of bottom section 31 comes in contact with and overlies integrated patch region 30 of top section 29, thereby sealing the bottom panel means 29-30 of prior art container apparatus 28 towards providing a substantially sift-proof bottom panel.

Figure 6A:
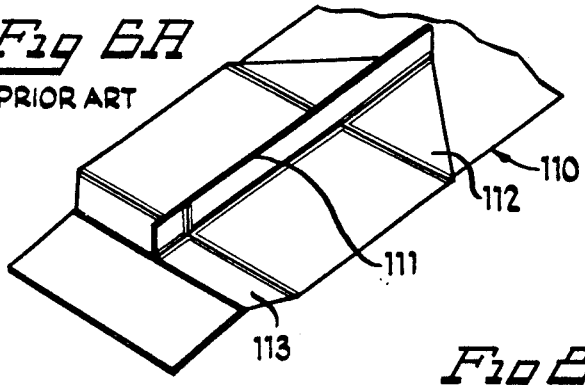
Fig 6A PRIOR ART
FIG. 6A is a perspective view of a portion of prior art bag in which a vertically oriented preliminary bottom panel weld has been fabricated in order to render the bottom panel construction "sift-proof"
Figure 6B:
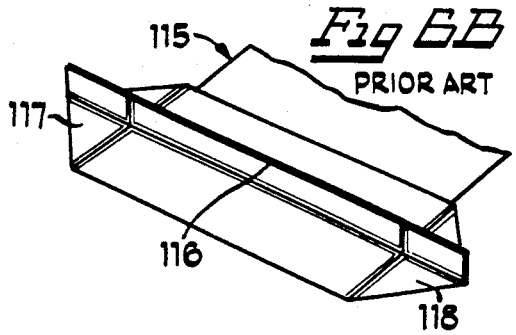
Fig 6B PRIOR ART
FIG. 6B is a perspective view of a prior art bag in which a horizontally oriented preliminary weld has been utilized to likewise render "sift-proof" the bottom panel closure means of such prior art bags prior to re-articulation of the flaps and securement through attachment of a non-integrated outer patch.

FIGS. 6A and 6B disclose prior art utilization of vertical and horizontal preliminary welds in order to render bottom panel constructions substantially "sift-proof". In FIG. 6A, prior art bag 110 is shown in which preliminary weld 111 has been positioned and formed over the entire transverse bottom of bag 110, prior to folding over of flaps 112 and 113—which includes an integrated patch to further restrainably seal and isolate the preliminary weld 111. In FIG. 6B, a horizontal weld is shown along bottom of prior art bag 115 in which horizontal weld 116 runs the entire transverse width of the bag to render a sift-proof construction before the seam of weld 116 is flattened to enable flaps 117 and 118 to be articulated over the weld. In such a construction an independent, non-integrated patch would typically be adhesively applied to the bag to further seal and isolate the preliminary weld construction. As shown in both FIGS. 6A and 6B the vertical preliminary weld of FIG. 6A and horizontal preliminary weld of FIG. 6B typically emanate upon formation into a third dimension requiring substantial cost effort and certain restrictions and limitations on the processing of such a bottom closure technique.

While a preferred embodiment of the present invention is shown in FIGS. 7 through 15 utilizing a heat sealable adhesive material, as described hereinbelow, the invention contemplates the utilization of other suitable adhesive materials, such as a cohesive adhesive, which will only seal upon alignment with another like layer of cohesive, as further described below; as well as other types of adhesive. In these alternative embodiments, the utilization of heat to bond adhesive to paper or adhesive to adhesive may be eliminated.

Figure 7:
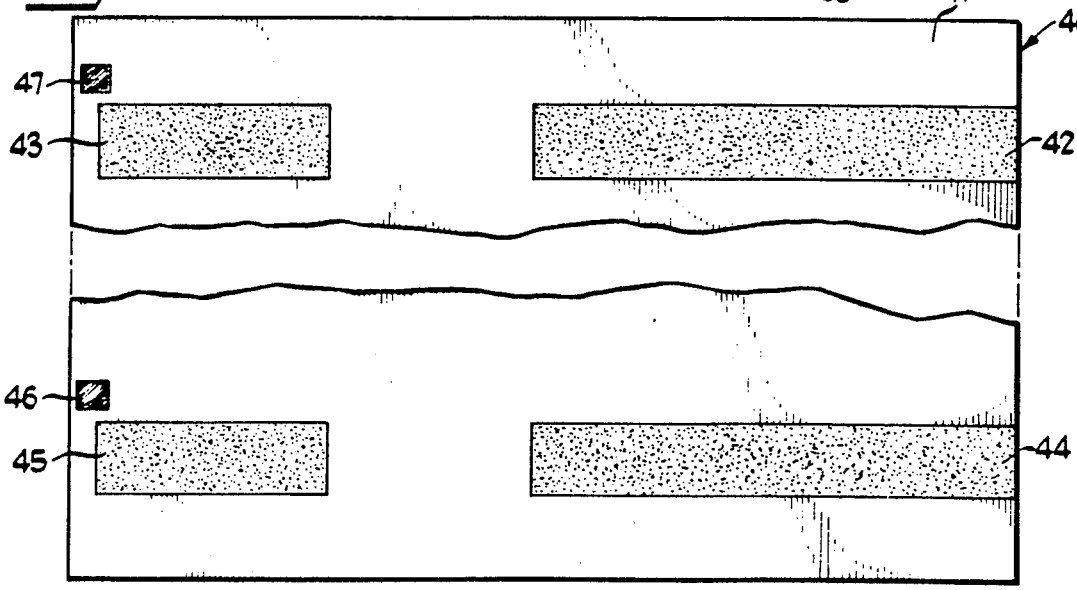
FIG. 7 of the drawings is an elevated, fragmented view of the exterior surface of the present non-articulated bag closure invention, comprising a single unitary ply of material onto which sealable adhesive material is positioned prior to articulation into the contiguous tube member.

A single ply sheet for forming a bag means of non-articulated sealable container apparatus 40 is shown in FIG. 7, prior to formation into multiple contiguous tubes. Applied to exterior surface 41 of container apparatus 40 is heat sealable adhesive material 42, 43, 44 and 45, respectively. Additionally located on exterior surface 41 of container apparatus 40 are machine marking indicia 46 and 47, which indicia are utilized by the container apparatus forming machine, commonly known as a tuber, to determine the proper location for the application of heat sealable adhesive material 42, 43, 44 and 45 as well as the proper dimensions which container apparatus 40 should be cut and formed to.

Figure 8:
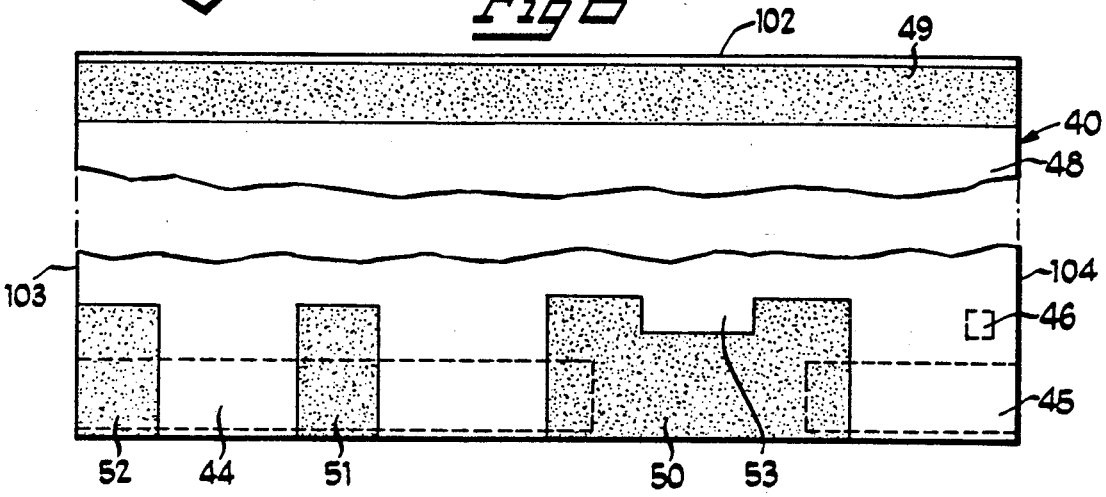
FIG. 8 of the drawings is an elevated rear view of the interior surface of a non-articulated ply of bag means onto which a pattern of sealable adhesive material has been deposited, prior to articulation into the contiguous tube member.

Interior surface 48 of the bag means comprising container apparatus 40 is shown in FIG. 8 in a non-deployed and non-articulated configuration. Heat sealable adhesive material 49 is a continuous strip of material extending from side edge 103 to side edge 104, which is located proximate to upper edge 102 of container apparatus 40 on interior surface 48, for sealing the top of the bag after filling with contents. Also applied to interior surface 48 are heat sealable adhesive materials 50, 51 and 52 each of which are positioned proximate to contiguous tube bottom end 101, extending upwardly towards top edge 102. Furthermore, heat sealable adhesive materials 51 and 52 are positioned so as to correspond to and overlap, upon articulation, heat sealable adhesive material region 44 located on exterior surface 41 of container apparatus 40. Heat sealable adhesive material 50 dimensionally overlaps, in non-articulated sheet form, at least a portion of both heat sealable adhesive material regions 44 and 45. Heat sealable adhesive material 50 further includes non-adhesive region 53 so that the bottom panel means 66 through 71 will not adhere to back panel means 62 upon full articulation and sealing of bottom panel means 66 through 71 of container apparatus 40.

Figure 9:
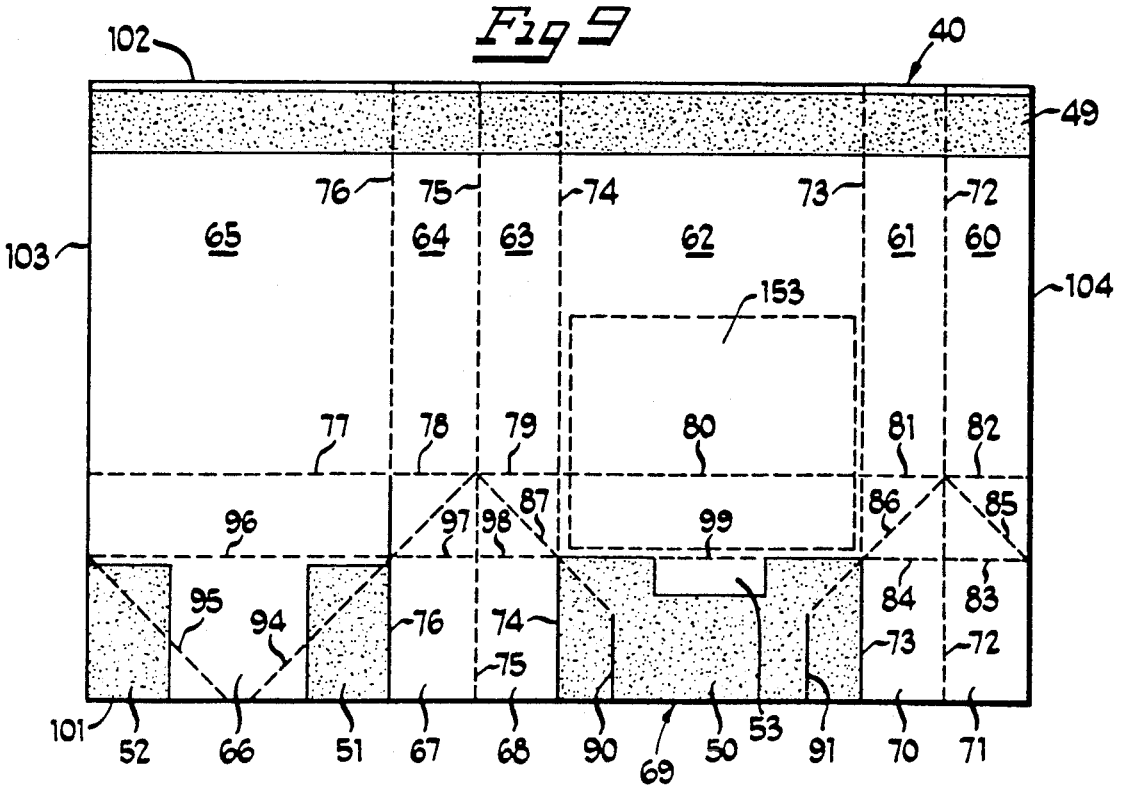
FIG. 9 is an elevated rear view of the interior surface of the bag material of FIG. 8 in which said sealable adhesive material is shown positioned relative to the respective folds utilized to articulate the contiguous tube member into various panel members forming the container apparatus.

The interior surface of container apparatus 40 is further illustrated in FIG. 9 as containing various folds and panels, prior to articulation and formation into a contiguous tube member. Again, heat sealable adhesive material 49 is a continuous strip between side edges 103 and 104, located proximate to top edge 102 thereby being located on front panel means 65, side panel means 63-64, back panel means 62 and side panel means 60-61. Front panel means 65 is bounded by top edge 102, side edge 76, bottom edge 96 and side edge 103 and further includes bag collapse fold 77. Hingedly emanating from bottom edge 96 is front panel closure flap means 66 which is bounded by front closure flap fold 96, side edges 76 and 103 and contiguous tube bottom end 101. Also included in front panel closure flap means 66 are heat sealable adhesive material columns 51 and 52 which are operably positioned adjacent to side edges 76 and 103 and front flap closure fold 96 and contiguous tube bottom end 101 respectively. Front panel closure flap means 66 further contain gusseted collapse folds 94 and 95 each of which traverse upwardly from contiguous tube bottom end 101 towards front flap fold 96, so as to dissect heat sealable adhesive materials 51 and 52 respectively, thereby allowing adhesive materials 51 and 52 to create an adhesive to adhesive bond upon folding and articulation of front panel closure flap means 66, about gusseted collapse folds 94 and 95, respectively.

Gusseted side panels 63-64 and 60-61 as shown in FIG. 9, are bounded by side edges 76 and 74 and 73 and 104 respectively, top edge 102, bottom edge 97-98 and 83-84 respectively and are comprised of gusseted side panel 63 and 64 and 60 and 61 respectively. Gusseted side panels 63 and 64 are hingedly attached to each other at gusset fold 75 and gusseted side panels 60 and 61 are similarly hingedly attached to each other at gusset fold 72. Gusseted side panels 63-64 and 60-61 further include bag collapse folds 79-78 and 82-81 respectively, as well as at least a portion of gusseted collapse folds 87, 94, 85 and 86 respectively. Also, hingedly emanating from gusseted side panels 63-64 and 60-61 are side panel closure flap means 68-67 and 71-70 which are bounded by side flap folds 98-97 and 83-84, side edges 76-74 and 104-73 and contiguous tube bottom end 101, respectively.

Operably positioned and hingedly emanating from gusseted side panels 63-64 and 60-61 is back panel means 62 which is bounded by top end 102, side edges 74 and 73 and bottom edge 99. Back panel means 62 further include bag collapse fold 80 as well as may include a heat enhancing susceptor element 100, a portion of which may be positioned below bag collapse fold 80. Back panel closure flap means 69 is attached and hingedly emanating from back panel means 62 at back flap fold 99 and is bounded by back flap fold 99, side edges 73 and 74 and contiguous tube bottom end 101. Back panel closure flap means 69 further contains laterally displaced longitudinal slits 90 and 91 which extend vertically from contiguous tube bottom end 101 towards back flap fold 99, and which are positioned so as to form an integrated patch 88 (see FIG. 12 upon articulation of container apparatus 40 into a contiguous bottom sealed tube. As further shown in FIG. 9, the majority of back panel closure flap means 69 is covered with heat sealable adhesive material 50, except for non-adhesive region 53 which is devoid of any such heat sealable adhesive material. Non-adhesive region 53 is positioned so that, upon articulation of bottom panel means 66 through 71 non-adhesive region 53 becomes adjacent to and in contact with back panel means 62 so as to prevent adherence of back panel closure flap means 69 to back panel means 62 to, in turn, prevent container apparatus 40 from being unusable.

Upon articulation of container apparatus 40 into a contiguous tube, the container apparatus 40 is folded about its longitudinal axis so that side edge 104 overlaps side edge 103 of front panel means 65 and front panel closure flap means 66, thereby forming the contiguous tube. Similarly, front panel closure flap means 66, side panel closure flap means 67-68 and 70-71, and back panel flap means 69 fold inwardly about front flap fold 96, side flap fold 78-79 and 84, 83 and back flap fold 99 towards the interior region of the contiguous tube, and bottom panel means 66 through 71 fold to a position for operable engagement of heat sealable adhesive materials 50, 51 and 52; thereby securing front panel closure flap means 66, side panel closure flap means 67-68 and 70-71 and back panel closure flap means 69 in place. Closure flap means 69 includes an integrated closure patch 88. Also shown in FIG. 9 is heat enhancing element 153, preferably comprising a susceptor member for microwave cooking.

Figure 10:
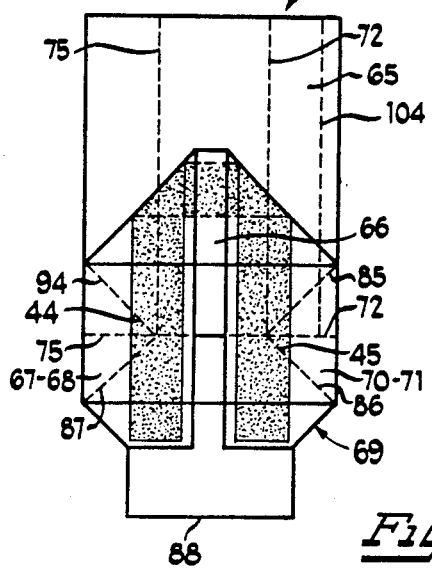
FIG. 10 is an elevated front view of a partially articulated container apparatus corresponding to the present invention in which the side panel closure flap means are articulated into a preliminary closure position with the front panel closure flap means being positioned adjacent to the front panel member prior to full articulation and sealing, showing only the sealable adhesive material applied to the exterior surfaces of the panels.

Partially articulated and deployed container apparatus 40 is shown in FIG. 10. Side panel closure flaps 67-68 and 70-71 have been folded about side panel flap fold 97-98 and 83-84 respectively, to adopt a position overlapping a portion of front panel means 65 and back panel means 62, while being substantially parallel to both front panel means 65 and back panel means 62. Similarly, front panel closure flap means 66 has been articulated and folded about front flap fold 96 so as to overlay front panel means 65. Bottom panel closure flap means 69 has been formed into an integrated sealing patch 88 capable of completing the sealing of bottom panel means 66 through 71, to provide a substantially sift-proof lower periphery. Such sealing is accomplished through heat sealable adhesive materials 44 and 45 which are positioned on the exterior surface of the front panel closure flap means 66, side panel closure flap means 67-68 and 70-71 and a portion of back panel closure flap means 69. When fully articulated, heat sealable adhesive materials 44 and 45 provide an adhesive-to-adhesive bond, thereby creating a reinforced, substantially sift-proof seal around the entire periphery of bottom panel means 66 through 71.

Figure 11:
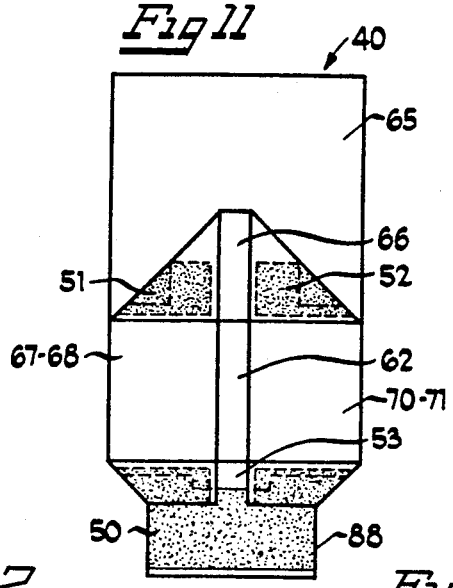
FIG. 11 is an elevated front view of a partially articulated container apparatus corresponding to the present invention in which the side panel closure flap means are articulated into a preliminary closure position with the front panel closure flap means being positioned adjacent to the front panel member prior to full articulation and sealing, showing only the sealable adhesive material applied to the interior surfaces of the panels.

FIG. 11 shows container apparatus 40 in the same partially articulated and deployed configuration as shown in FIG. 10, showing only the heat sealable adhesive deployed on the interior surface 48 of the container. Side panel closure flap means 67-68 and 70-71 are folded about side flap folds 97-98 and 84-83 and overlap a portion of front panel means 65 and back panels means 62. Heat sealable adhesive materials 50, 51 and 52 are operably positioned on interior surface 48 of the lower periphery of container apparatus 40 and specifically on front closure flap means 66 and integrated patch 88. Furthermore, heat sealable adhesive material 51 and 52 have created an adhesive-to-adhesive bond as well an adhesive-to-paper bond upon the interior surface 48 of front panel closure flap means 66.

Figure 12:
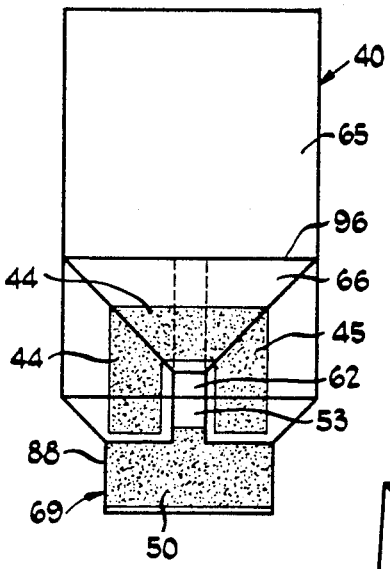
FIG. 12 is an elevated front view of the front and side panel closure flaps of the present invention being operably positioned for full articulation of the bottom panel means and subsequent sealing.
Figure 13:
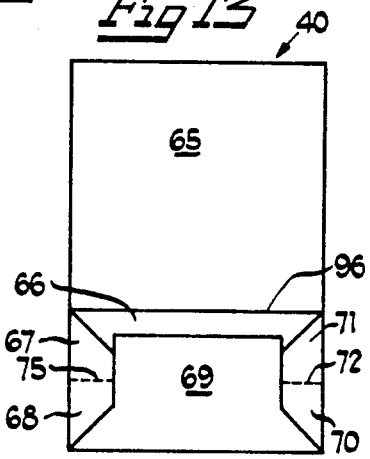
FIG. 13 is an elevated front view of the completely articulated and sealed bottom panel means of the container apparatus of FIGS. 7 through 12.

In FIG. 12 front panel closure flap means 66 is folded about front flap 96 and brought into contact with side panel closure flap means 67-68 and 70-71 so as to seal a portion of respective side panel closure flap means 67-68 and 70-71. Heat sealable adhesive material 44 and 45 now form a continuous U-shaped ring which is positioned to engage heat sealable adhesive material 50 located on integrated patch 88 of back panel closure flap means 69 when the back panel closure flap means 69, is folded about back flap fold 99. When back panel closure flap means 69 is folded about back flap 99, non-adhesive region 53 is brought into contact with and overlies back panel means 62 to provide an area of non-adherence and permit the proper articulation and deployment of bottom panel means 66 through 71. FIG. 13 illustrates a completely articulated and sealed bottom panel means 66 through 71 such that front panel closure flap means 66 overlies side panel closure flaps means 67-68 and 70-71. Likewise back panel closure flap means 69 is adjacent to and overlies at least a portion of front panel closure flap means 66 and side panel closure flap means 67-68 and 70-71. The integrated patch configuration of back panel closure flap means 69 completes the sift-proof seal of the bottom panel means 66 through 71.

Figure 14:
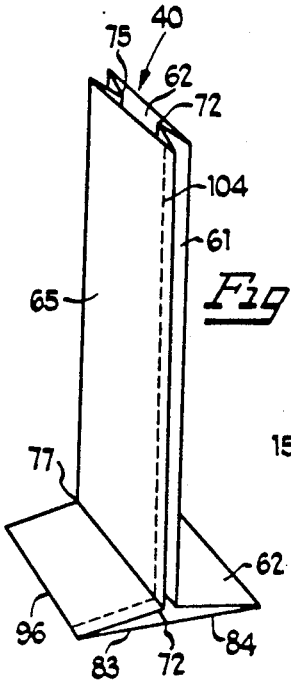
FIG. 14 is a top, side perspective view of the present container apparatus in which the bottom panel means is completely articulated and sealed at its bottom, while the gusseted side panel means are only partially articulated and deployed prior to filling with contents.
Figure 15:
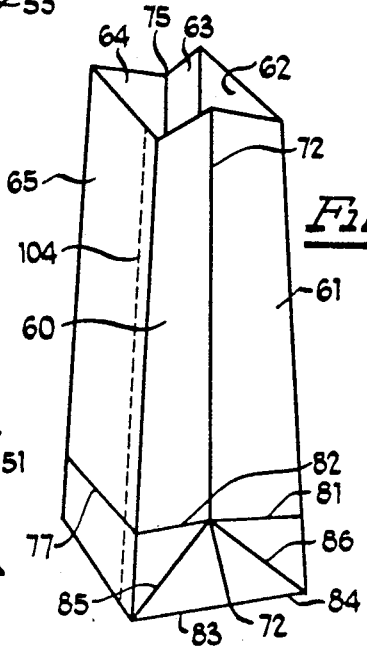
FIG. 15 is a top, side perspective view of a completely articulated sealed bottom and container apparatus, with fully expanded front, back and side panel members.
Figure 16:
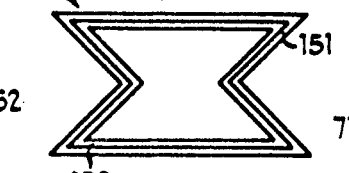
FIG. 16 is a top plan view of an apparatus formed by multiple plies of material.

Container apparatus 40 is shown in perspective in FIG. 14 with gusset folds 75 and 72 sandwiched between and adjacent to back panel means 62 and front panel means 65. Side edge 104 is adjacent to and overlaps front panel means 65 at side edge 103, being secured to front panel means 65 by a non-heat sealable adhesive FIG. 15 illustrates a completely articulated, open container apparatus 40 in which gusset folds 72 and 75 have been directed away from each other from each other, with gusseted side panels 63-64 and 61-60 becoming substantially coplanar and parallel to each other respectively; thereby allowing insertion and removal of various articles into and from within container apparatus 40. FIG. 16 illustrates a bag apparatus 150 of multiple plies 151 and 152 in which the invention may be embraced.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention. For example, it should be readily apparent that other kinds of suitable adhesives can be utilized in place of the heat sealable adhesive described hereinabove (and without the application of heat) without departing from the scope of the invention. As described hereinabove, such suitable adhesives may include cohesive adhesives which are capable of forming the sift-proof sealed periphery through an adhesive to adhesive bond.

What is claimed is:

1. A sealable square bottom container apparatus for use in storing, shipping and using various contents contained therewithin, said container apparatus preventing the inadvertent migration and release of oils, steam, fluids and fine powdered materials, among other types of contents, from within said container apparatus to the outside environment during said storage, shipping and use, said container apparatus comprising:

bag means for containing said articles, said bag means including a front panel, a back panel, side panels and a bottom panel;

each of said front, back and side panels having an interior surface and an exterior surface, top and bottom edges and first and second side edges;

said side panels comprising at least first and second side panels interposed between and operably connecting said front and back panels, respectively, so as to form a contiguous tube about a longitudinal axis, said contiguous tube including a top end bounded by said top edges of said front, back and side panels, a bottom end and an interior region bounded by said interior surfaces of said front, back and side panels;

each of said front, back and side panels further including front, back and side panel closure flap means for forming said bottom panel and having corresponding interior and exterior surfaces and side edges, said front, back and side panel closure flap means emanating downwardly from the respective bottom edges of each of said front, back and side panels respectively, to collectively form said bottom panel upon articulation and sealing of said respective panel closure flap means, each of said front, back and side panel closure flap means emanating from said respective ones of said front, back and side panels at front, back and side flap folds respectively interposed therebetween, said side panel closure flap means respectively forming a substantially rectangular first side bottom panel and a substantially rectangular second side bottom panel, opposite said first side bottom panel, as part of said bottom panel, upon articulation of said side panel closure flap means, said first side bottom panel emanating from said first side panel at a first of said side flap folds and said second bottom side panel emanating from said second side panel at a second of said side flap folds, each of said first and second side bottom panels, upon said articulation and folding at said respective side flap folds, being positioned independent of each other in a non-overlapping orientation;

said front and back panel closure flap means respectively forming a front bottom panel and a back bottom panel opposite said front bottom panel upon articulation of said front and back panel closure flap means, said front bottom panel emanating from said front panel at said front flap fold and said back bottom panel emanating from said back panel at said back flap fold, with said front and back bottom panels, upon said articulation and folding at said respective front and back flap folds, being positioned in overlapping orientation sealable adhesive material operably positioned on the interior and exterior surfaces of at least one of said front, back and side panel closure flap means, prior to articulation, for operable, overlapped sealing of said front and back bottom panels over one another and over said first and second side bottom panels, upon articulation of said closure flap means to seal same;

said sealable adhesive material being positioned on at least two of said front, back and side panel closure flap means to create, upon said sealing, a substantially closed, positively locked, continuous periphery of sealed attachment among said front, back and side panel closure flap means, said sealable adhesive material on said front, back and side panel closure flap means, and, in turn, said front, back and side bottom panels, respectively formed thereby, imparting to said continuous periphery of sealed attachment, a substantially rectangular shape within said formed bottom panel, having a region devoid of said adhesive material therewithin said periphery, to thereby maximize the region of sealed attachment against which the weight of said contents may be distributed within said interior region;

said substantially closed, positively locked, continuously sealed periphery along said bottom panel forming a sift-proof bottom panel closure that is substantially restrictive to the migration of oils, steam, fluids and finely powdered materials.

2. The sealable square bottom container apparatus according to claim 1 in which said sealable adhesive material comprises a heat sealable adhesive material.

3. The sealable square bottom container apparatus according to claim 2 in which said heat sealable adhesive material comprises a polyvinyl acetate heat sealable adhesive.

4. The sealable square bottom container apparatus according to claim 1 in which said sealable adhesive material positioned on said at least two of said front, back and side panel closure flap means creates said positively locked, continuous periphery sealed attachment to, in turn, form said sift-proof bottom panel closure, upon articulation, sealable juxtapositioning and affixation with another aligned layer of said sealable adhesive material positioned on said at least two said front, back and side panel closure flap means;

said sealable alignment and affixation of said one layer of sealable adhesive material on said at least two front, back and side panel closure means with said other aligned layer of said sealable adhesive materials respectively positioned on said at least two said front, back and side panel closure means creating an improved adhesive-to-adhesive bond thereby further enhancing said positively locked, sealed periphery.

5. The sealable square bottom container apparatus according to claim 4 in which said sealable adhesive material comprises a heat sealable adhesive material.

6. The sealable square bottom container apparatus according to claim 4 in which said sealable adhesive material comprises a cohesive adhesive material incapable of bonding directly to other non-adhesive coated surfaces upon curing, but sealable to a corresponding aligned and juxtaposed layer of like cohesive adhesive material.

7. The sealable square bottom container apparatus according to claim 4 in which said heat sealable adhesive material comprises a polyvinyl acetate heat sealable adhesive.

8. The sealable square bottom container apparatus according to claim 6 in which said cohesive adhesive material comprises a cohesive having an applied thickness in the range of 0.5 to 1.5 mil, and a solid content ranging from 50 to 60 percent.

9. The sealable square bottom container apparatus according to claim 1 in which:

said at least first and second side panels comprises first and second gusseted side panels operably positioned between said front and back panels respectively;

each of said respective first gusseted side panels including a first side edge operably attached to said first and second side edges of said front panel, respectively, and a second side edge operably positioned opposite to said first side edge of said first gusseted side panel and extending inwardly toward said interior region of said contiguous tube;

said respective second gusseted side panels including a first side edge operably attached to said first and second side edges of said back panel, respectively, and a second side edge operably positioned opposite said first side edge of said second gusseted side panel and extending inwardly toward said interior region of said contiguous tube, each of said respective second side edges of said first and second gusseted side panels being attached to each other at a gusseted fold to form inwardly extending gussets;

said respective side panels further including gusset collapse folds operably positioned between said respective first and second side edges of said respective first and second gusseted side panels.

10. The sealable square bottom container apparatus according to claim 1 in which at least one of said front and back panels includes bag collapse folds operably positioned between said respective bottom and top edges of said respective front and back panels for the facilitated formation of said bottom panel, said bag collapse folds horizontally traversing the distance between said side edges of one of said front and back panels thereby permitting a portion of said front and back panels to fold to a position substantially parallel to the position of said bottom panel.

11. The sealable square bottom container apparatus according to claim 1 in which:

said sealable adhesive material is operably positioned on at least a portion of both said interior and exterior surfaces of said front and back panel closure flap means, said sealable adhesive material being further operably positioned on said exterior surface of said side panel closure flap means for cooperation with said sealable adhesive material on said front and back panel closure flap means, thereby creating an adhesive to adhesive sift-proof seal, when said front, back and side panel closure flap means are articulated into said bottom panel and sealed.

12. The sealable square bottom container apparatus according to claim 11 in which said back panel closure flap means further comprises two longitudinally positioned, laterally displaced slits extending upwardly from said bottom end of said contiguous tube towards said bottom edge of said back panel to form an integrated closure patch within at least one of said front and back bottom panels, to facilitate formation of said substantially closed, positively locked, continuous periphery of sealed attachment among said front, back and side panel closure flap means to, in turn, completely seal said bottom panel upon full deployment, articulation and sealing of said bottom panel of said container apparatus.

13. The sealable square bottom container apparatus according to claim 11 in which said sealable adhesive material is operably positioned between said respective side edges of said back panel closure flap means, said back flap fold and said bottom end of said contiguous tube on said interior surface of said back panel closure flap means;

said sealable adhesive material on said interior surface of said back panel closure flap means being positioned so as to operably engage and cooperate with itself and said sealable adhesive material upon said exterior surfaces of said front and side panels to form an adhesive to adhesive sift-proof seal to, in turn, enhance the strength of said seal along the lower periphery of said bottom panel;

said interior surface of said back panel closure flap means further including a non-adhesive region proximate to said back flap fold and extending towards said bottom end of said contiguous tube;

said non-adhesive region being adjacent to and in contact with said back panel upon articulation of said bottom panel to, in turn, permit complete sealing of said front, back and side panel closure flap means to each other without adhering said back panel closure flap means to said back panel.

14. The sealable square bottom container apparatus according to claim 11 in which said sealable adhesive material operably positioned on said interior surface of said front panel closure flap means comprises two distinct columns of sealable adhesive material, extending between said bottom edge of said contiguous tube and said front flap fold, said respective columns each being positioned proximate to the respective opposite side edges of said front panel;

said sealable adhesive material columns being positioned on said interior surface of said front panel closure flap means so as to operably engage at least a portion of itself upon articulation and folding of said interior surface of said front panel closure flap means during articulation and formation of said bottom panel.

15. The sealable square bottom container apparatus according to claim 12 wherein said sealable adhesive material operably positioned on said exterior surfaces of said front, back and side panel closure flap means comprises a substantially continuous lateral ring of sealable adhesive material, said exterior surface of said back panel closure flap means between said laterally displaced slits, articulating into said integrated closure patch, and being devoid of said sealable adhesive material on said exterior surface.

16. The sealable square bottom container apparatus according to claim 1 in which said top edges of said front, back and side panels are sealable after placement of said contents within said container apparatus by top seal means thereby completely enclosing and containing said contents therewithin.

17. The sealable square bottom container apparatus according to claim 16 in which said top seal means comprises a substantially continuous lateral ring of sealable adhesive material around the interior periphery of and proximate to said top edges of said front, back and side panels.

18. The sealable square bottom container apparatus according to claim 1 in which said contiguous tube comprises a sheet of bag material folded over itself about said longitudinal axis, and continuously attached from said top end of said contiguous tube to said bottom end of said contiguous tube through tube attachment means for maintaining the configuration of said contiguous tube, said tube attachment means comprising a water based adhesive.

19. The sealable square bottom container apparatus according to claim 1 in which said of said bag means comprises one ply of bag material, said ply of bag material being formed of paper.

20. The sealable square bottom container apparatus according to claim 1 in which said bag means comprises two or more plies of bag material, said outer ply of bag material being formed of paper.

21. The sealable square bottom container apparatus according to claim 20 in which said bag means comprises an inner ply and an outer ply of bag material, said inner and outer plies of bag material being formed of paper.

22. The sealable square bottom container apparatus according to claim 20 in which said bag means comprises an inner and an outer ply of bag material, said inner ply of bag material being formed of a substantially grease-proof material and said outer ply of bag material being formed of paper.

23. The sealable square bottom container apparatus according to claim 20 wherein said back panel further includes heat enhancing means operably positioned between said inner and outer plies of bag material forming said back panel for intensifying and concentrating heat within said bag means.

* * * * *

UNITED STATES PATENT AND TRADEMARK OFFICE

CERTIFICATE OF CORRECTION

PATENT NO. : 5,314,252

DATED : May 24, 1994

INVENTOR(S) : Thomas W. Happ

It is certified that error appears in the above-indentified patent and that said Letters Patent is hereby corrected as shown below:

| | |
|---|---|
| Col. 9, Line 11 | After "Fig. 12" insert -- ) --. |
| Col. 10, Line 44 | After adhesive insert -- . --. |

Signed and Sealed this

Twenty-sixth Day of December, 1995

*Attest:*

Bruce Lehman

BRUCE LEHMAN

*Attesting Officer*

*Commissioner of Patents and Trademarks*